US007673682B2

(12) United States Patent
Daily

(10) Patent No.: US 7,673,682 B2
(45) Date of Patent: Mar. 9, 2010

(54) WELL CASING-BASED GEOPHYSICAL SENSOR APPARATUS, SYSTEM AND METHOD

(75) Inventor: William D. Daily, Livermore, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 11/237,054

(22) Filed: Sep. 27, 2005

(65) Prior Publication Data

US 2007/0068673 A1 Mar. 29, 2007

(51) Int. Cl.
*E21B 17/10* (2006.01)
*E21B 47/01* (2006.01)

(52) U.S. Cl. ..... 166/254.2; 166/241.6; 166/66

(58) Field of Classification Search ..... 166/242.1, 166/241.1, 241.6, 66, 250.01, 254.2, 250.11
See application file for complete search history.

(56) References Cited

U.S. PATENT DOCUMENTS 4,775,009 A * 10/1988 Wittrisch et al. ..... 166/250.11
5,243,562 A * 9/1993 Laurent et al. ..... 367/25
5,367,911 A * 11/1994 Jewell et al. ..... 73/861.08
5,509,474 A * 4/1996 Cooke, Jr. ..... 166/64
5,524,709 A * 6/1996 Withers ..... 166/250.1
5,661,236 A * 8/1997 Thompson ..... 73/152.18
6,125,935 A * 10/2000 Shahin, Jr. ..... 166/250.14
6,131,658 A * 10/2000 Minear ..... 166/250.01
6,155,292 A 12/2000 Kurata
6,374,913 B1 * 4/2002 Robbins et al. ..... 166/66
6,480,000 B1 * 11/2002 Kong et al. ..... 324/338
7,071,697 B2 * 7/2006 Rioufol et al. ..... 324/366
2002/0016679 A1 2/2002 Thomas et al.
2002/0063200 A1 * 5/2002 Jones et al. ..... 250/227.14
2004/0232924 A1 11/2004 Hilleary et al.

FOREIGN PATENT DOCUMENTS

EP 0 195 985 A2 10/1986

(Continued)

OTHER PUBLICATIONS

William D. Daily et al, Low-cost reservoir tomographs of electrical resistivity; The Leading Edge May 2004 pp. 472-480.

(Continued)

*Primary Examiner*—Kenneth Thompson
(74) *Attorney, Agent, or Firm*—James S. Tak; John H. Lee

(57) ABSTRACT

A geophysical sensor apparatus, system, and method for use in, for example, oil well operations, and in particular using a network of sensors emplaced along and outside oil well casings to monitor critical parameters in an oil reservoir and provide geophysical data remote from the wells. Centralizers are affixed to the well casings and the sensors are located in the protective spheres afforded by the centralizers to keep from being damaged during casing emplacement. In this manner, geophysical data may be detected of a sub-surface volume, e.g. an oil reservoir, and transmitted for analysis. Preferably, data from multiple sensor types, such as ERT and seismic data are combined to provide real time knowledge of the reservoir and processes such as primary and secondary oil recovery.

25 Claims, 5 Drawing Sheets

FOREIGN PATENT DOCUMENTS

WO WO 03065076 A2 * 8/2003

OTHER PUBLICATIONS

William D. Daily et al, Electrical Resistance tomography, The Leading Edge May 2004 438-442.

A.L. Ramirez et al, Stochastic Inversion of Electrical Resistivity Changes Using a Markov Chain Monte Carlo Approach, Journal of Geophysical Research vol. 110, paper B02101 1 of 18.

* cited by examiner

WELL CASING-BASED GEOPHYSICAL SENSOR APPARATUS, SYSTEM AND METHOD

The United States Government has rights in this invention pursuant to Contract No. W-7405-ENG-48 between the United States Department of Energy and the University of California for the operation of Lawrence Livermore National Laboratory.

I. FIELD OF THE INVENTION

The present invention relates to oil well monitoring operations and more particularly relates to a geophysical sensor apparatus, system, and method using well casings to emplace sensors protected by centralizers down into a well borehole to monitor and characterize conditions in, for example, an oil reservoir.

II. BACKGROUND OF THE INVENTION

Large capital investments are typically required to produce any oil reservoir, and much of that investment is in the construction of deep wells which are located in the very part of the reservoir that is of greatest interest to characterize and monitor, i.e. where the oil is. One of the primary goals, therefore is to improve recovery efficiency for existing resources because the cost of developing new fields is increasingly expensive. This is accomplished by deriving useful information about field production.

In the prior art, seismic tomography, which performed from the surface only, or conventional borehole geophysics has been used. However, moving sondes in boreholes for logging or crosshole tomography, or moving sources and receivers on the surface for reflection seismology, are time consuming and expensive operations. For example, the cost of a 3D seismic survey can reach $1 million or more. Conventional borehole geophysics is less expensive but has an upfront cost and a downtime cost. Additionally, conventional borehole techniques tend to have a narrow filed of view. For example, borehole logging is focused on a narrow strip around the well bore. Similarly, seismic crosshole tomography is insensitive to all but a narrow region directly between the well bores. Alternatively, prior art practices have utilized sensors which were placed inside the casings, which prevented operation of oil recovery operation during that monitoring/sensing period. In any of these monitoring methods, the time interval between surveys is generally limited to the survey costs and the reluctance to remove wells from production due to downtime costs.

Because sensors placed at these locations are thereby nearest to the volume of interest and most sensitive to the reservoir and the processes resulting in oil production, there is a need for placing sensors deep in oil reservoirs, and a need to monitor critical parameters, e.g. geophysical data, in an oil reservoir to provide knowledge of the reservoir and related processes such as primary and secondary recovery, but in a manner which does not affect production operations. Therefore there is a need for a monitoring tool capable of providing low-cost, long-term, near-continuous imaging, while having minimum impact on production operations, and not limited by mobilization costs, survey costs, downtime costs, or demobilization costs.

IV. SUMMARY OF THE INVENTION

One aspect of the present invention includes a geophysical sensor apparatus, comprising: an elongated well casing capable of being emplaced in a borehole; a sensor located outside the well casing for detecting a geophysical parameter at an emplacement depth; means for communicating detection data from the sensor out to a remote monitoring location; and a centralizer affixed to a section of the well casing so that during emplacement the well casing and the sensor are spaced from the borehole sidewalls to protect the well casing and the sensor from damage.

Another aspect of the present invention includes a well casing-based geophysical sensor apparatus, comprising: a plurality of elongated well casings capable of being serially connected into a casing string during emplacement in a borehole; a plurality of sensors located outside the well casings along various sections thereof corresponding to various emplacement depths, said sensors being of at least one type per emplacement depth for detecting at least one type of geophysical parameter per emplacement depth; means for communicating detection data from the sensors out to a remote monitoring location; and a plurality of centralizers fixedly connected to different sections of the well casings so that during emplacement the well casings and the sensors are spaced from the borehole sidewalls to protect the well casings and the sensors from damage.

Another aspect of the present invention includes a well casing-based geophysical sensor system comprising: at least two geophysical sensor apparatuses each capable of emplacement in one of a distributed network of boreholes, with each geophysical sensor apparatus comprising: a plurality of elongated well casings capable of being serially connected into a casing string during emplacement in a borehole; a plurality of sensors located outside the well casings along various sections thereof corresponding to various emplacement depths, said sensors being of at least one type per emplacement depth for detecting at least one type of geophysical parameter per emplacement depth; means for communicating detection data from the sensors out to a remote monitoring location; and a plurality of centralizers fixedly connected to different sections of the well casings so that during emplacement the well casings and the sensors are spaced from the borehole sidewalls to protect the well casings and the sensors from damage.

Another aspect of the present invention includes a method for using well casings to monitor geophysical parameters of a sub-surface volume, comprising: emplacing in each of a distributed set of well boreholes a plurality of serially connectable well casings having: (a) a plurality of sensors of at least two types located outside the well casings for detecting at least two type of geophysical parameters; (b) means for communicating detection data from the sensors out to a remote monitoring location; and (c) a plurality of centralizers fixedly connected to different sections of the well casings so that during emplacement the well casings and the sensors are spaced from the borehole sidewalls to protect the well casings and the sensors from damage; in each of the distributed set of well boreholes, grouting in place the emplaced plurality of serially connectable well casings and the plurality of sensors, so that the sensors come into contact with the sidewalls of the corresponding well borehole so as to be sensitive to the at least two types of geophysical parameters of the surrounding sub-surface volume; receiving at the remote monitoring location detection data of the at least two types of geophysical parameters; and processing said detection data to characterize the sub-surface volume.

V. BRIEF DESCRIPTION OF THE DRAWINGS

The accompanying drawings, which are incorporated into and form a part of the disclosure, are as follows.

VI. DETAILED DESCRIPTION

Generally, the present invention is directed to a geophysical sensor apparatus, system, and method using well casings to emplace geophysical sensors at various in-ground emplacement depths in a well borehole, and to subsequently monitor and characterize down-well conditions of, for example, an oil reservoir. As such, the present invention may be described as a "smart casing" for its ability to collect geophysical data, and not function simply as a mechanical structure. Additionally, the present invention includes centralizers fixedly secured to the well casings to protect geophysical sensors and wires/cables from damage which would otherwise be possible when emplacing the sensor-fitted casing down a borehole due to the external location of the sensors and wires to the well casing. Such exterior location is required because in order to operate properly, geophysical sensors must come in contact with the surrounding formation rock, typically achieved by grouting, i.e. cementing, the well casing and sensors in place (see FIG. 2). In this manner, sensor-fitted well casings may be connected together to produce a casing string having a plurality of centralizers protecting a plurality of sensors at various depths in the borehole. Furthermore, multiple casing strings may be emplaced in a network of boreholes to characterize the spatial and temporal state of sub-surface volume of formation rock, e.g. an oil reservoir, using tomographic processing and analysis for example. The potential benefit of this approach is that substantial information may be gained about the spatial and temporal state of a reservoir, with little incremental capital cost of a well. While the advantages of the present invention have direct application in oil recovery operations, it is appreciated that the present invention may be utilized for other well operations generally where geophysical measurements are made.

Figure 1:
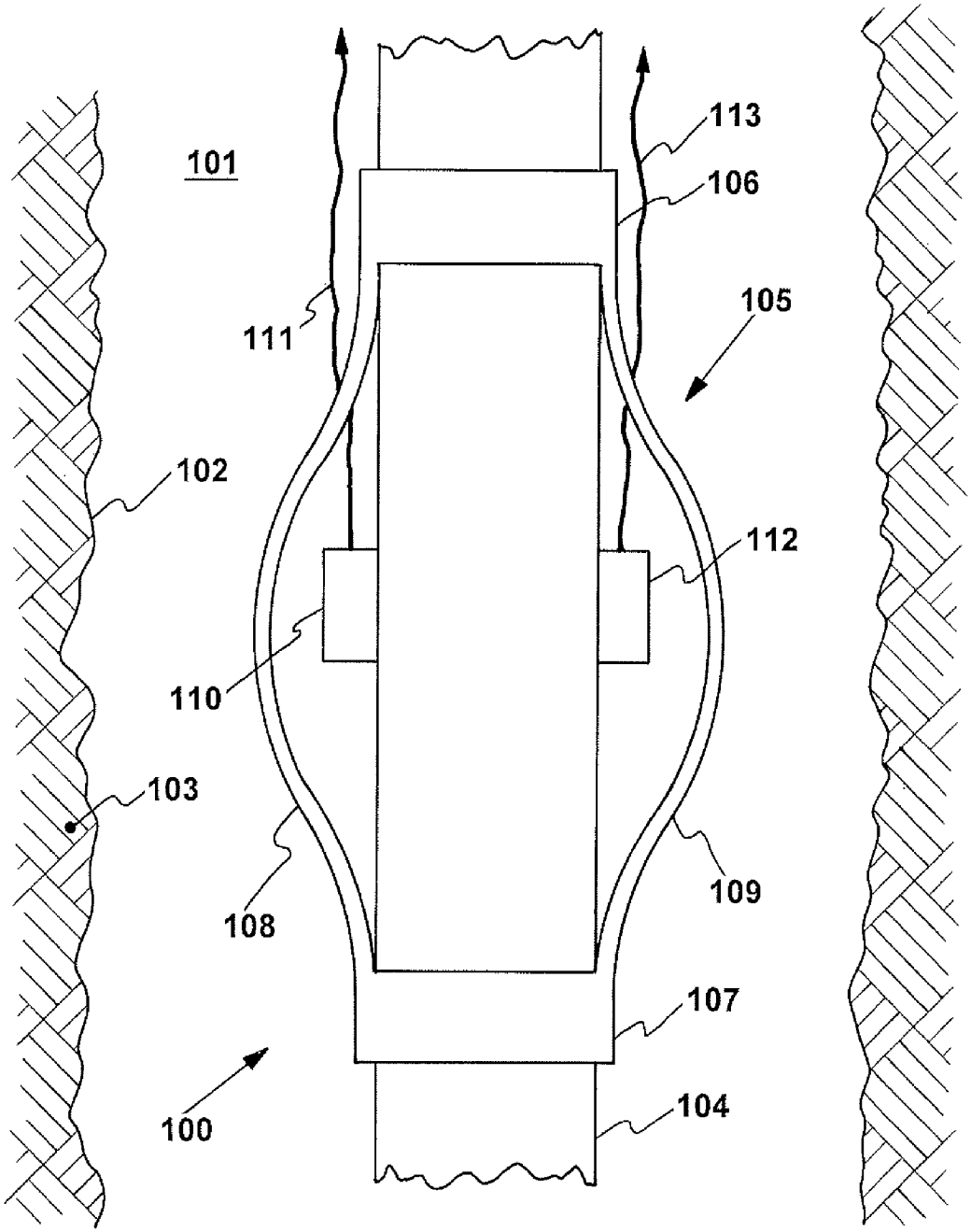
FIG. 1 shows an enlarged side view of a section of an exemplary embodiment of the present invention emplaced in a borehole, and prior to grouting.
Figure 2:
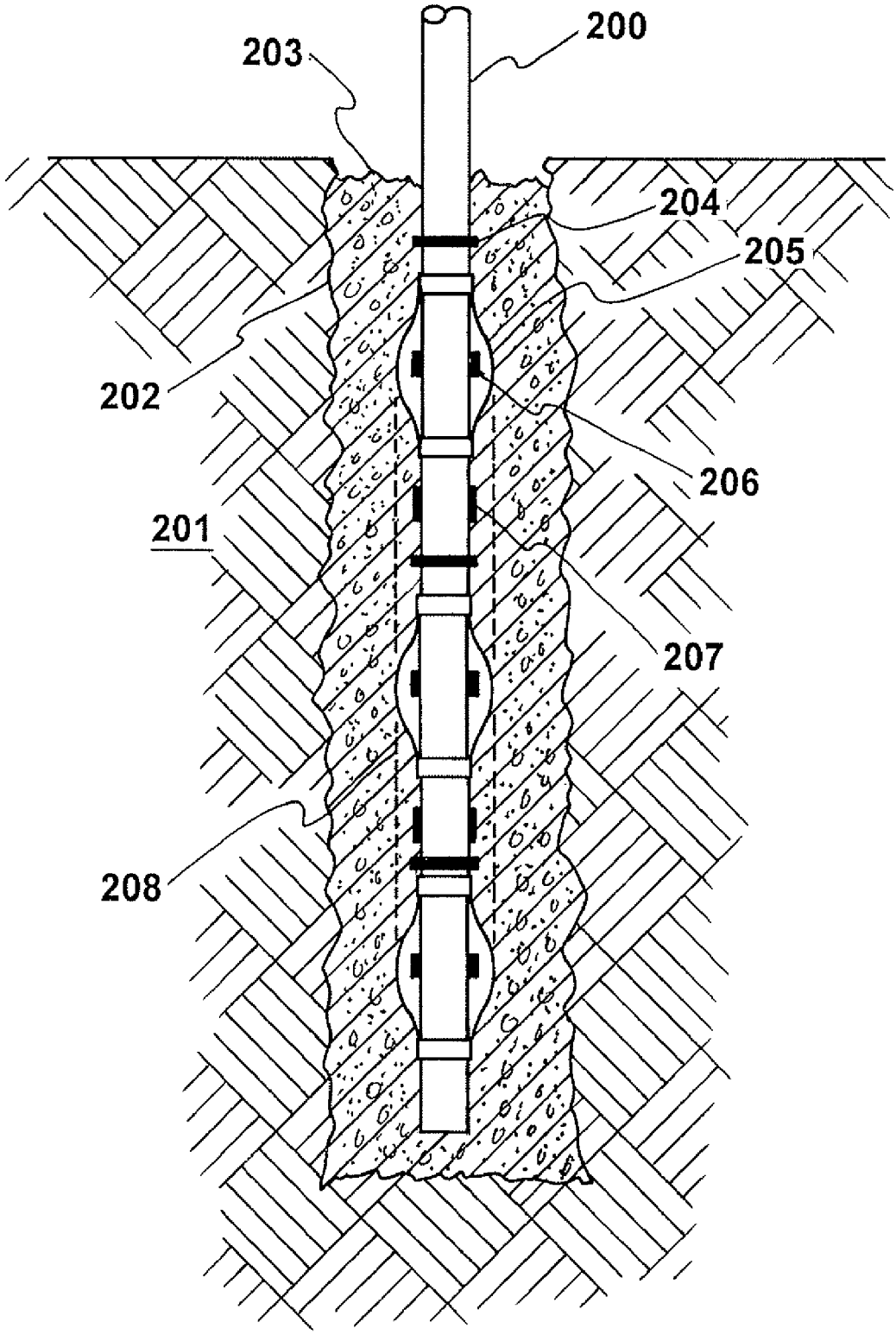
FIG. 2 shows a side view of an exemplary embodiment of the present invention particularly showing multiple well casings serially connected to each other to form a casing string and having centralizers and sensor packages spaced along the length of the string.

Turning now to the drawings, FIG. 1 shows an enlarged side view of a section of an exemplary embodiment of the well casing-based geophysical sensor apparatus of the present invention, generally indicated at reference character 100. The apparatus is shown emplaced in a borehole 101 having sidewalls 102 in a rock/earth formation 103, but prior to grouting (see FIG. 2 showing grouting). Generally, the apparatus includes an elongated well casing 104; a geophysical sensor (e.g. 110) capable of detecting a predetermined geophysical parameter in the surrounding formation; a device, conduit, or other means for communicating detected data out to a remote monitoring location (not shown), such as for example wire conduit 111 connecting sensor 110; and a centralizer 105 affixed to a section of the well casing 104 for spacing the well casing and the sensor from the borehole sidewalls 102 so as to protect them from damage during the emplacement operation.

The well casing 104 is preferably of a type known and used in the field of oil recovery and other well operations, i.e. an elongated, large diameter pipe often constructed from plain carbon steel or other materials, such as stainless steel, titanium, aluminum, fiberglass, etc, in a range of sizes and material grades. The end joints (not shown) of the casing are typically fabricated with either (1) male threads on each end with short-length casing couplings having female threads joining the casing joints together, or (2) a male thread on one end and female threads on the other end, so as to enable end-to-end serial connection with adjacent well casings. In well completion operations, well casings are lowered into a borehole, serially connected to other well casings to form a casing string in an operation commonly called "running pipe", and grouted, i.e. cemented, into place. In this manner, the casing forms a primary structural component of the well borehole and serves several important functions, including: preventing the sidewalls of the borehole from caving into the borehole; isolating the different formations to prevent the flow or crossflow of formation fluids, and providing a means for maintaining control of formation fluids and pressure as the well is drilled.

As shown in FIG. 1, the centralizer 105 is preferably a bow-spring centralizer commonly used in the industry, having bow springs 108,109 (e.g. three or more) attached at each end to end collars 106,107 which are fixedly secured to the well casing 104. Generally, centralizers operate to keep the well casing and sensors centered in the borehole 101 and spaced from the borehole sidewalls 102. However, centralizers in the prior art are typically not affixed to the well casing, but are allowed to slide thereon and are stopped by a coupling collar connecting two casings together. In contrast, the centralizer 105 of the present invention is fixedly secured to the well casing 11 by welding, bolting, etc. one or more of the end collars 106, 107 to the well casing so as to prevent sliding of the centralizer relative to the well casing. In this manner, the centralizer 105 forms a known protected region along a particular section of the well casing which does not change. FIG. 1 shows the two geophysical sensors 110 and 112 located between the well casing 104 and the bow springs 108,109 of the centralizer 105, such that the sensors are directly protected by the bow springs from the borehole sidewalls 102 during emplacement. It is appreciated that while FIG. 1 shows the sensors mounted directly on the well casing, the sensors may alternatively be mounted or integrally formed on the centralizer.

One or more types of sensors may be utilized on the same section of a well casing for detecting a corresponding number of geophysical parameters at the same emplacement depth, as suited for a particular application. For example, the two sensors 110 and 112 in FIG. 1 are located at the same section of the well casing 104 so as to detect at the same emplacement depth. Such sensors at the same section are preferably of a different type from each other so as to detect a different geophysical parameter. Detector types may include, for example, ERT ("electrical resistance tomography") electrodes, seismic receivers (cross-well), tiltmeters, EM induction coils and thermocouples. In a preferred embodiment, the two sensors 110 and 112 are an ERT electrode and a seismic receiver. These two sensor/modality types are preferably chosen because the data from these geophysical sensors provide highly complementary data about a reservoir. The seismic velocity is very sensitive to structural properties/features of a formation or reservoir and the electrical resistivity is very sensitive to pore fluid properties of the reservoir. The sensors 110 and 112 are also shown each having a corresponding wire conduit 111, 113 (preferably insulated) running outside the well casing and connecting the sensor to a remote monitoring location (not shown). And preferably, the detection modalities are provided together in an integrated detection instrument package capable of installation at a desired location or section of a well casing. In the alternative, the sensors may be separately installable.

FIG. 2 shows a side view of an exemplary embodiment of the present invention particularly showing multiple well casings serially connected to each other (by connecting collars, e.g. 204) in a borehole 202 of a formation 201 to form a casing string 200, and having multiple centralizers (e.g. 205) and sensor packages (e.g. 206, 207) spaced along the length of the string corresponding to various emplacement depths. Preferably, about 10 or more sensor packages (each corresponding to a different emplacement depth) are used per well, i.e. borehole. Some sensors, such as 206, are shown located within the span of a centralizer, while others, such as 207 are shown located between centralizers outside the span of any one. In either case, the sensors are located in the region protected by the centralizers, indicated at reference character 208, since by spacing multiple centralizers sufficiently close to each other, e.g. 15 feet, the protected region 208 is effectively continuous between centralizers, and therefore may extend along substantially the entire length of the casing string. In this manner, the centralizers serve to space not only the well casing, but also the sensors and the connecting wires from the borehole sidewalls 102 to protect them from damage during casing emplacement. As such, the protected region is not necessarily limited only to a space within the physical span of the centralizer such as shown in FIG. 1, but may also include adjacent areas outside a centralizer's physical span, including between centralizers, as shown in FIG. 2.

Also shown in FIG. 2, after emplacing the casing string 200 in the borehole 202, the string is grouted in place, which is a standard practice after casing emplacement. Grouted material provides the solid filler material to bridge the gap between the sensors and the borehole sidewall, and provide contact therebetween to enable the sensors to detect the associated geophysical parameter from the surrounding formation 201.

Figure 3:
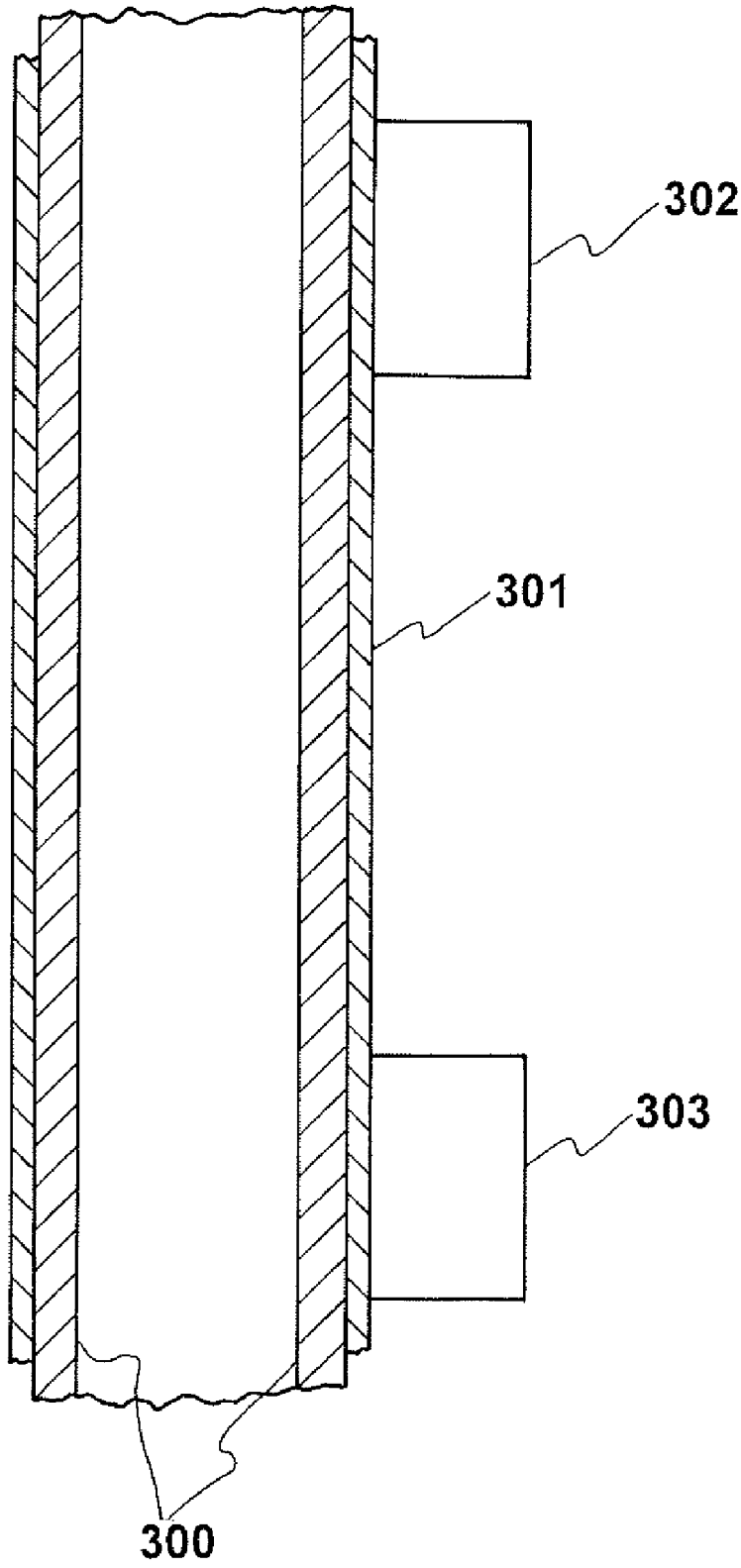
FIG. 3 shows a side view of an exemplary embodiment of the present invention particularly showing two ERT electrode sensors electrically insulated from the well casing and each other by means of an insulative coating.

FIG. 3 shows a preferred method of isolating an electrically-sensitive sensor, such as an ERT electrode, to prevent electrical shorting and enable proper operation. In particular, two ERT electrodes 302 and 303 are shown attached to the well casing 300, which is typically made of steel. However, in order to electrically insulate the electrodes 302 and 303 from the steel casing and from each other, the casing 300 is coated with an insulating layer 301 of non-conducting covering (e.g., paint). The non-conductive casing covering must be electrically insulating, inexpensive, abrasion resistant, easily applied, high temperature stable (lower priority) and chemically resistant (to CO2, oil, gas, water), such as for example the material sold under the trademark "Ryt-wrap" [by Tuboscope, Houston Tex. 77001]. The use of an insulating layer over the entire casing surface can mitigate the effect of possible scrapes and scratches on the ERT data. And the sensor packages are attached so as not to damage this electrical insulation, such as by clamping to the insulated casing. As shown in FIG. 3, the coating preferably covers the entire surface distance between the two electrodes 302 and 303 because can otherwise adversely affect the current flow.

Figure 4:
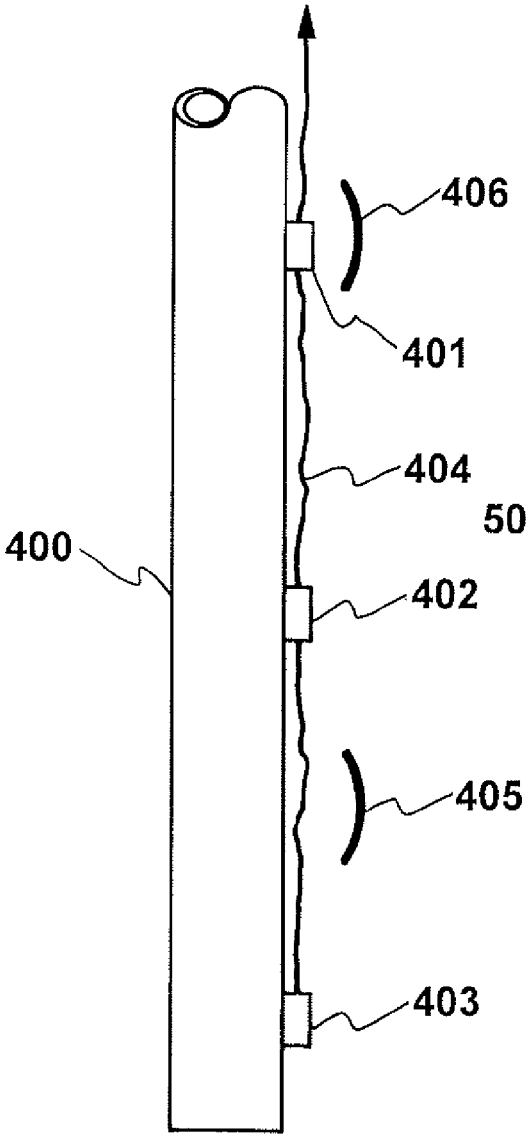
FIG. 4 shows a schematic view of an exemplary embodiment of the present invention having sensors at different emplacement depths serially connected to each other for communicating detected data out from the borehole to a remote monitoring location.
Figure 5:
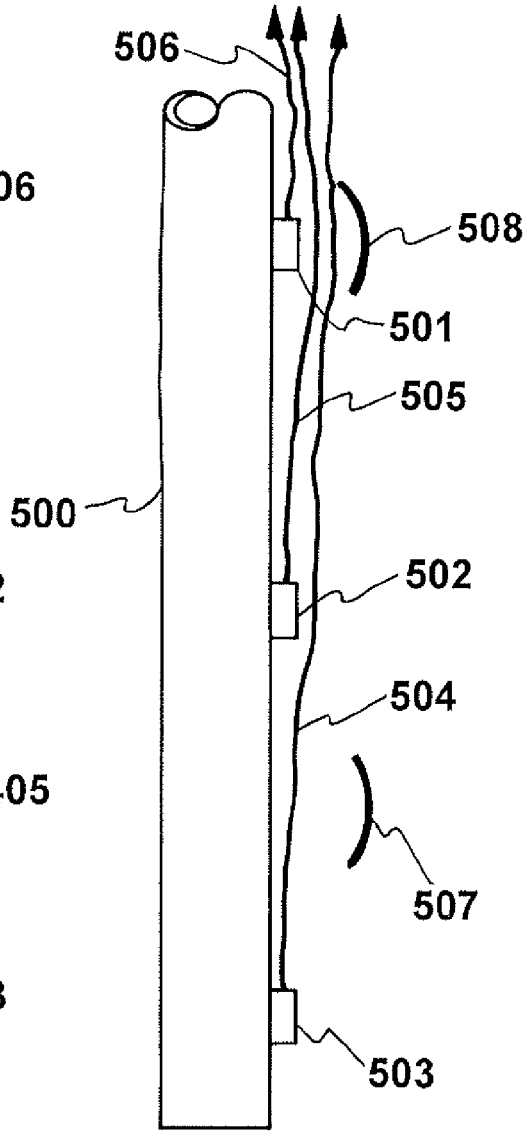
FIG. 5 shows a schematic view of an exemplary embodiment of the present invention having sensors at different emplacement depths each connected to a remote monitoring location in parallel with each other.

FIGS. 4 and 5 show two embodiments of routing wire between sensor packages at different sections of a casing string and thus different emplacement depths. In particular, FIG. 4 shows a schematic view of an exemplary embodiment of the present invention having sensors 401-403 located at different sections of a casing 400 and at corresponding emplacement depths, and serially connected to each other for communicating detected data out from the borehole to a remote monitoring location (not shown). The serial connection is by wire conduit 404 leading out to the remote monitoring location. Centralizers are represented at 406 and 407 to illustrate the spacing and protected region formed thereby, to also protect the wire conduit 404 from damage. Similarly, FIG. 5 shows a schematic view of an exemplary embodiment of the present invention having sensors 501-503 located at different sections of a casing 500 and at corresponding emplacement depths. Each of the sensors 501, 502, and 503 are routed/connected to a remote monitoring location (not shown) in parallel with each other by means of wire conduit 506, 505, and 504, respectively. Here too, centralizers are represented by 507 and 508 illustrating the protected region in which the sensors and wires are located.

Figure 6:
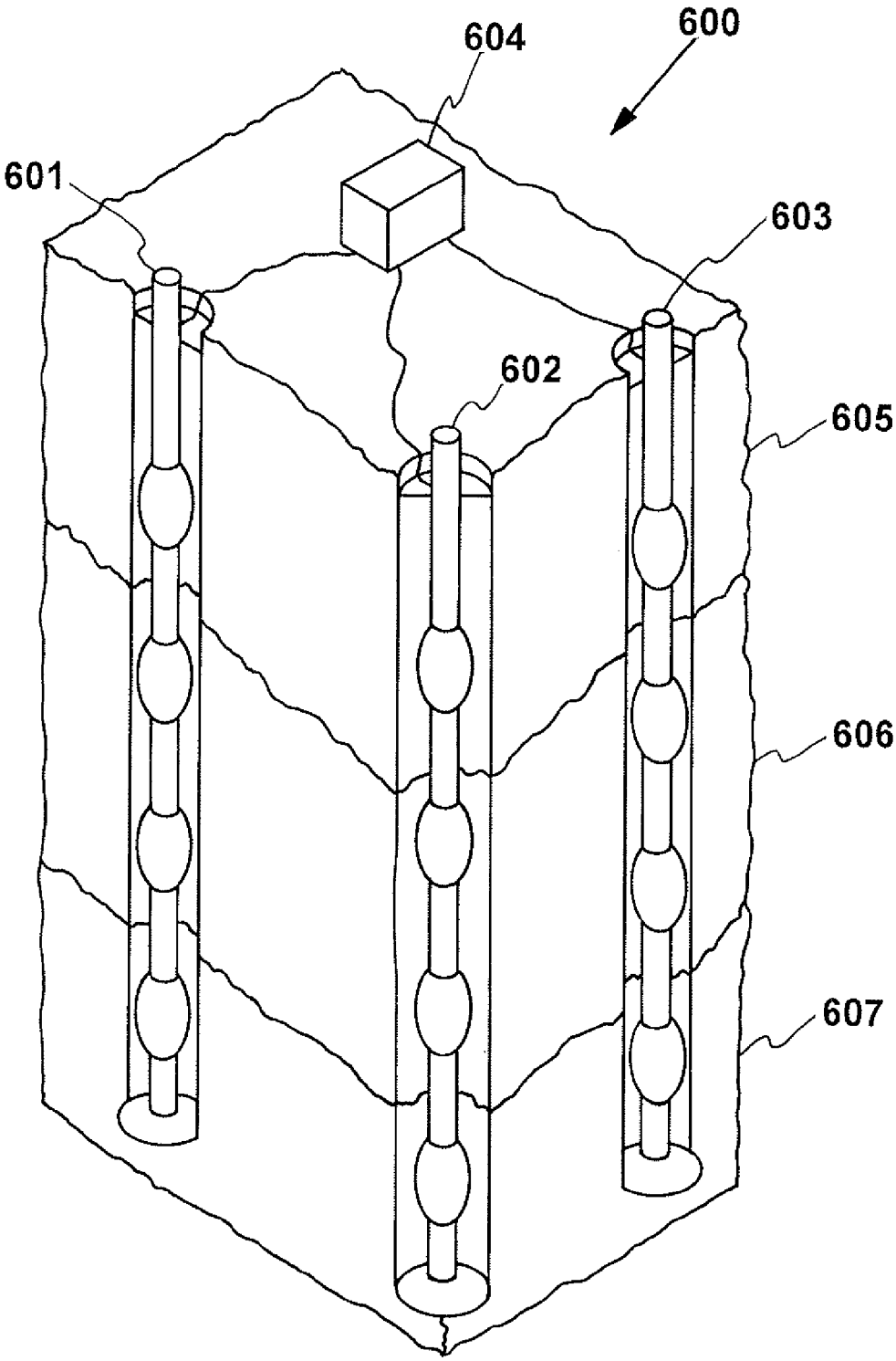
FIG. 6 shows a perspective view of multiple well casings emplaced in a distributed network of boreholes as used in an exemplary system of the present invention and connected to a remote monitoring location.

And FIG. 6 shows a perspective view of a system embodiment of the present invention, generally indicated at reference character 600. The system includes multiple well-casing based apparatuses, such as 601, 602, and 603, of the present invention emplaced in a distributed network of boreholes and connected to a remote monitoring location 604, which may be a computer server, at the surface of the detection site or remotely located from the site. Multiple wells, so instrumented, would constitute a sensor network capable of dense three-dimensional sampling of the reservoir. In particular, such a system can enable real-time, high resolution process monitoring in deep oil reservoirs, such as using ERT data to produce 3D images of reservoir electrical properties. And by adding data from a complementary/ orthogonal data parameter, addition formation properties may be determined. For example, complementary data, such as seismic data from a seismic receiver, can provide surface-source to borehole-detector seismic data for creating an analogous travel time tomograph. Of course, each data set would reveal different formation properties so that the two together would be complementary. Analysis of the collected data may be performed, for example, with a stochastic engine to characterize the sub-surface volume formation. The potential benefits of such a methodology include: (1) forming 3D images of seismic and electrical parameters in a reservoir; (2) the sensors are very sensitive to reservoir properties because they are not at the surface (hundreds of meters from the region of interest) but are imbedded directly in the reservoir pay zone; (3) low operating costs because the sensors do not move; they are simply mulitiplexed by a data scanner at the surface; (4) there is no disruption of normal use of the well-production continues without interruption; and (5) although adding to the capital cost of well completion, this technology can actually have a low capital cost when amortized over the useful lifetime of a well. With regard to (3), this feature makes practical very long term monitoring. Presently, seismic surveys, while very valuable, are very costly and therefore practical only a small fraction of the time they could be useful.

While particular operational sequences, materials, temperatures, parameters, and particular embodiments have been described and or illustrated, such are not intended to be limiting. Modifications and changes may become apparent to those skilled in the art, and it is intended that the invention be limited only by the scope of the appended claims.

I claim:

1. A geophysical sensor apparatus, comprising:

an elongated well casing capable of being emplaced in a borehole;

a sensor located outside the well casing for detecting a geophysical parameter at an emplacement depth;

means for communicating detection data from the sensor out to a remote monitoring location;

a centralizer affixed to a section of the well casing so that during emplacement the well casing and the sensor are spaced from the borehole sidewalls to protect the well casing and the sensor from damage; and at least one additional sensor(s) located outside the well casing and protected by the spacing produced by the centralizer, wherein the sensors are all located at the same section of the well casing and thus the same emplacement depth, and are of different types for detecting different geophysical parameters at the same emplacement depth, wherein the sensors are of two types including an electrical resistance tomography (ERT) electrode and a seismic receiver.

2. The apparatus of claim 1, wherein the sensors are affixed to the well casing.

3. The apparatus of claim 1, wherein the sensors are affixed to the centralizer.

4. The apparatus of claim 1, wherein the sensors are integrated with the centralizer.

5. The apparatus of claim 1, wherein the sensors are located between the well casing and the centralizer within the physical span of the centralizer.

6. The apparatus of claim 1, wherein the sensors are located outside the physical span of the centralizer.

7. The apparatus of claim 1, further comprising at least one additional set of sensors located at different sections of the well casing and thus different emplacement depths from the first set of sensors, for detecting the same geophysical parameter at the different emplacement depths, and wherein the ERT electrode sensors are electrically isolated from each other.

8. The apparatus of claim 1, wherein the ERT electrodes are electrically isolated from each other by being electrically insulated from the well casing.

9. The apparatus of claim 8, wherein the well casing is coated with an insulating layer to electrically insulate the ERT electrodes from the well casing and each other.

10. The apparatus of claim 1, wherein the means for communicating detection data comprises wire conduit connecting the sensors to the remote monitoring location, said wire conduit routed alongside the well casing so that the centralizer affixed to the well casing also spaces the wire conduit from the borehole sidewalls to protect the wire conduit from damage during emplacement.

11. The apparatus of claim 10, wherein the wire conduit serially connects the sensors located at the different emplacement depths.

12. The apparatus of claim 10, wherein the wire conduit separately connects each sensor to the remote monitoring location in parallel.

13. The apparatus of claim 1, further comprising at least one additional centralizer(s) affixed to a section of the well casing corresponding to a different emplacement depth than other centralizers.

14. A well casing-based geophysical sensor apparatus, comprising:

a plurality of elongated well casings capable of being serially connected into a casing string during emplacement in a borehole;

a plurality of sensors located outside the well casings along various sections thereof corresponding to various emplacement depths, said sensors being of at least one type per emplacement depth for detecting at least one type of geophysical parameter per emplacement depth, with two types of sensors used at selected emplacement depths for detecting two types of geophysical parameters at the same selected emplacement depth wherein the two types of sensors include an electrical resistance tomography (ERT) electrode and a seismic receiver;

means for communicating detection data from the sensors out to a remote monitoring location; and a plurality of centralizers fixedly connected to different sections of the well casings so that during emplacement the well casings and the sensors are spaced from the borehole sidewalls to protect the well casings and the sensors from damage.

15. The apparatus of claim 14, wherein the same type of sensor is used for at least two selected emplacement depths for detecting the same geophysical parameter at different emplacement depths.

16. The apparatus of claim 15, wherein the same-type sensors are the ERT electrodes which are electrically isolated from each other.

17. The apparatus of claim 16, wherein the ERT electrodes are electrically isolated from each other by being electrically insulated from the well casings.

18. The apparatus of claim 17, wherein the well casings are coated with an insulating layer to electrically insulate the ERT electrodes from the well casings and each other.

19. The apparatus of claim 14, wherein the means for communicating detection data comprises wire conduit connecting the sensors to the remote monitoring location, said wire conduit routed alongside the well casings so that the centralizers affixed to the well casings also space the wire conduit from the borehole sidewalls to protect the wire conduit from damage during emplacement.

20. The apparatus of claim 19, wherein the wire conduit serially connects the sensors located at the different emplacement depths.

21. The apparatus of claim 19, wherein the wire conduit separately connects each sensor to the remote monitoring location in parallel.

22. A well casing-based geophysical sensor system comprising:

at least two geophysical sensor apparatuses each capable of emplacement in one of a distributed network of boreholes, with each geophysical sensor apparatus comprising:

a plurality of elongated well casings capable of being serially connected into a casing string during emplacement in a borehole;

a plurality of sensors located outside the well casings along various sections thereof corresponding to various emplacement depths, said sensors being of at least one type per emplacement depth for detecting at least one type of geophysical parameter per emplacement depth;

means for communicating detection data from the sensors out to a remote monitoring location; and a plurality of centralizers fixedly connected to different sections of the well casings so that during emplacement the well casings and the sensors are spaced from the borehole sidewalls to protect the well casings and the sensors from damage.

23. A method for using well casings to monitor geophysical parameters of a sub-surf ace volume, comprising:

emplacing in each of a distributed set of well boreholes a plurality of serially connectable well casings having: (a) a plurality of sensors of at least two types located outside the well casings for detecting at least two type of geophysical parameters; (b) means for communicating detection data from the sensors out to a remote monitoring location; and (c) a plurality of centralizers fixedly connected to different sections of the well casings so that during emplacement the well casings and the sensors are spaced from the borehole sidewalls to protect the well casings and the sensors from damage;

in each of the distributed set of well boreholes, grouting in place the emplaced plurality of serially connectable well casings and the plurality of sensors, so that the sensors come into contact with the sidewalls of the corresponding well borehole so as to be sensitive to the at least two types of geophysical parameters of the surrounding sub-surface volume;

receiving at the remote monitoring location detection data of the at least two types of geophysical parameters; and processing said detection data to characterize the sub-surface volume.

24. The method of claim 23, wherein the at least two types of sensors detect a corresponding number of geophysical parameters which provide orthogonal detection data, and said orthogonal detection data is processed by stochastic inversion to characterize the sub-surface volume.

25. The method of claim 24, wherein the at least two types of sensors include an electrical resistance tomography (ERT) electrode and a seismic receiver.

* * * * *